US011201023B2

(12) United States Patent
Koyama et al.

(10) Patent No.: US 11,201,023 B2
(45) Date of Patent: Dec. 14, 2021

(54) CHANGE-OVER SWITCH AND SWITCH DEVICE

(71) Applicant: OMRON Corporation, Kyoto (JP)

(72) Inventors: Taiki Koyama, Okayama (JP); Kazufumi Osaki, Okayama (JP); Akira Ueno, Koshigaya (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 16/971,397

(22) PCT Filed: Jan. 16, 2019

(86) PCT No.: PCT/JP2019/001039
§ 371 (c)(1),
(2) Date: Aug. 20, 2020

(87) PCT Pub. No.: WO2019/171770
PCT Pub. Date: Sep. 12, 2019

(65) Prior Publication Data

US 2021/0050165 A1 Feb. 18, 2021

(30) Foreign Application Priority Data

Mar. 9, 2018 (JP) ..... JP2018-043267

(51) Int. Cl.
*H01H 21/36* (2006.01)
*H01H 21/22* (2006.01)

(52) U.S. Cl.
CPC ..... *H01H 21/36* (2013.01); *H01H 21/22* (2013.01)

(58) Field of Classification Search
CPC ..... H01H 21/36; H01H 21/22; H01H 21/04
(Continued)

(56) References Cited

U.S. PATENT DOCUMENTS

2007/0272525 A1 11/2007 Suzuki
2008/0099316 A1 5/2008 Liu
(Continued)

FOREIGN PATENT DOCUMENTS

JP S9-14834 Y1 11/1934
JP 2005-222834 A 8/2005
(Continued)

OTHER PUBLICATIONS

An English translation of the International Search Report ("ISR") of PCT/JP2019/001039 dated Apr. 2, 2019.
(Continued)

*Primary Examiner* — Edwin A. Leon
*Assistant Examiner* — Iman Malakooti
(74) *Attorney, Agent, or Firm* — Metrolex IP Law Group, PLLC

(57) ABSTRACT

A change-over switch includes a swing member configured to swing in response to an operation from the outside, a contact member configured to swing about the swing axis identical to the axis of the swing member and including a plurality of movable contacts extending in different directions, and a substrate on which a fixed contact is formed, the fixed contact configured to contact the plurality of movable contacts of the contact member. In the change-over switch, the movable contact that contacts the fixed contact formed on the substrate is changed over by swinging of the contact member in conjunction with swinging of the swing member. A switch device includes a power source switch configured to open and close a circuit which supplies electric power to a power load, and a change-over switch configured to change over electric power supplied to the power load.

10 Claims, 16 Drawing Sheets

(58) Field of Classification Search
USPC ..... 200/293, 553, 61.54, 5 R, 6 R, 19.18, 200/19.07, 564, 252, 339
See application file for complete search history.

(56) References Cited

U.S. PATENT DOCUMENTS

| | | | | |
|---|---|---|---|---|
| 2013/0180836 | A1* | 7/2013 | Neriki | H01H 1/403 200/61.54 |
| 2015/0188242 | A1* | 7/2015 | Koyama | H02K 5/225 439/171 |

FOREIGN PATENT DOCUMENTS

| | | | | |
|---|---|---|---|---|
| JP | 2010-185176 | A | 8/2010 | |
| JP | 2010-250944 | A | 11/2010 | |
| JP | 2012-1188 | * | 1/2012 | B60H 1/00 |
| JP | 2012-1188 | A | 1/2012 | |
| JP | 2013-149350 | A | 8/2013 | |
| JP | 2015-219965 | A | 12/2015 | |

OTHER PUBLICATIONS

The Written Opinion("WO") of PCT/JP2019/001039 dated Apr. 2, 2019.

* cited by examiner

CHANGE-OVER SWITCH AND SWITCH DEVICE

TECHNICAL FIELD

The present invention relates to a change-over switch and a switch device including the change-over switch.

BACKGROUND ART

As a kind of trigger switch for controlling the operation of an electric power tool, trigger switches each including a change-over switch for switching the operation direction are commonly used. For example, Patent Document 1 discloses a technique of a trigger switch including a change-over switch.

PRIOR ART DOCUMENT

Patent Document

Patent Document 1: Japanese Unexamined Patent Publication No. 2015-219965

SUMMARY OF THE INVENTION

Problems to be Solved by the Invention

There is expected a potential demand for a function of switching the operation direction depending on the direction of tilting a change-over lever as a function of a trigger switch including such a change-over switch.

However, the trigger switch proposed in Patent Document 1 has a problem that the trigger switch is turned on only on one side of tilting of the change-over lever. Note that in order to configure the trigger switch disclosed in Patent Document 1 such that the operation direction is changed over depending on the tilting direction, there is a problem that the number of components increases and the structure becomes complicated.

The present invention has been made in view of such circumstances, and an object of the present invention is to provide a change-over switch that has a simple configuration and can change over the operation state depending on the tilting direction, Another object is to provide a switch device including the change-over switch according to the present invention.

Means for Solving the Problem

In order to solve the above problems, a change-over switch described in the present application includes a swing member configured to swing in response to an operation from the outside, a contact member configured to swing about the swing axis identical to the swing axis of the swing member and includes a plurality of movable contacts extending in different directions, and a substrate on which a fixed contact is formed, the fixed contact configured to contact each of the plurality of movable contacts of the contact member, in which the movable contact that contacts the fixed contact formed on the substrate is changed over by swinging of the contact member in conjunction with swinging of the swing member.

Furthermore, the change-over switch described in the present application includes, as the fixed contact formed on the substrate, a plurality of fixed contacts located on a first plane parallel to the swing axis and on opposite sides with respect to a second plane orthogonal to the first plane and including the swing axis, and as the movable contacts that the contact member includes, a plurality of movable contacts extending on opposite sides with respect to the second plane.

Furthermore, the change-over switch described in the present application includes a constant contact configured to electrically connect one of the plurality of movable contacts included in the contact member and the fixed contact formed on the substrate regardless of the swinging state of the contact member.

Furthermore, in the change-over switch described in the present application, the constant contact is part of the contact member, and slides in contact with the fixed contact by swinging of the contact member.

Furthermore, in the change-over switch described in the present application, the contact member including a plurality of contacts is formed from one conductive plate.

Furthermore, in the change-over switch described in the present application, the swing member includes a shaft portion through which the swing axis passes, and the contact member is formed from one conductive plate having a flexing portion that is flexed. The flexing portion is arranged in the shaft portion, and the plurality of movable contacts extend from both ends of the flexing portion.

Furthermore, in the change-over switch described in the present application, the contact member includes a cut-and-raised portion cut and raised to form a frame-shaped portion that forms a frame shape together with the flexing portion, and the swing member includes a holding portion fitted onto the frame-shaped portion formed by the flexing portion and the cut-and-raised portion and configured to hold the contact member in the shaft portion.

Furthermore, the switch device described in the present application includes a power source switch configured to open and close a circuit which supplies power to a power load, and a change-over switch configured to change over power to be supplied to the power load.

The change-over switch and the switch device described in the present application can change over the contact depending on the swing direction, and it is possible to expect simplification of the configuration.

Effect of the Invention

In the change-over switch and the switch device according to the present invention, the change-over switch is configured by using the swing member, the contact member, and the substrate, and the movable contact that contacts the fixed contact formed on the substrate is changed over by swinging of the contact member in conjunction with swinging of the swing member. As a result, it is possible to expect simplification of constituents even though different movable contacts and circuits are formed depending on the swing direction. Simplification of the constituents leads to various effects such as suppression of soaring costs.

MODE FOR CARRYING OUT THE INVENTION

Hereinafter, embodiments of the present invention will be described with reference to the drawings.

APPLICATION EXAMPLE

A switch device described in the present application is applied to various electric motor devices including electric power tools such as an electric screwdriver, an electric wrench, and an electric grinder. Furthermore, a change-over switch described in the present application is applied to various devices such as a switch device. In the embodiments illustrated below, such a switch device and a change-over switch will be described as a switch device 1 and a change-over switch 2 with reference to the drawings.

First Embodiment

Figure 1:
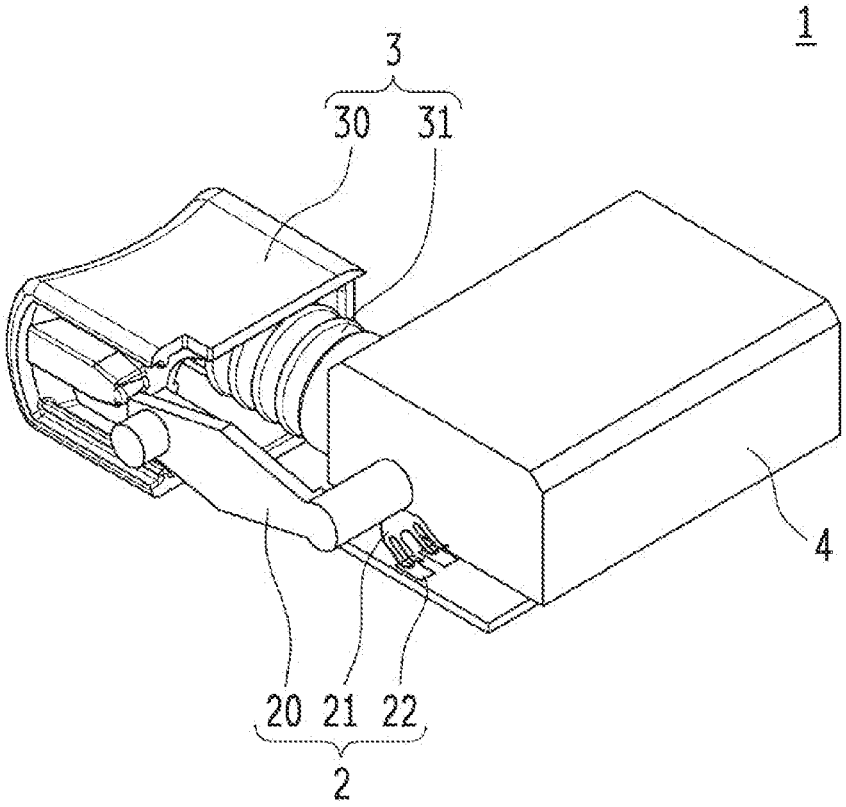
FIG. 1 is a schematic perspective view illustrating an example of the external appearance of a switch device described in the present application.

FIG. 1 is a schematic perspective view illustrating an example of the external appearance of the switch device 1 described in the present application. The switch device 1 illustrated in FIG. 1 is a schematic perspective view of the switch device 1 that can be incorporated in various electric motor devices such as an electric power tool. The switch device 1 includes a power source switch 3, a circuit section 4, and the like in addition to the change-over switch 2 described above.

The power source switch 3 is a switch such as a trigger switch operated by a user of the electric motor device. The power source switch 3 includes an operation member 30 which functions as a push button that can be pressed by an operator, and an urging member 31 such as a compression coil spring that urges the operation member 30 in the upward direction against the pressing direction. In the case of using the electric motor device, if the operator presses the operation member 30 of the power source switch 3, the state transitions to an on state where energization to a power load M (see FIG. 2 and the like) such as an electric motor provided in the electric device is started. If the operator stops pressing of the operation member 30, the operation member 30 is urged by the urging member 31 and is pushed up, and the state transitions to an off state where energization to the power load M is stopped. That is, when the operator presses the operation member 30, energization to the power load M is started, and when the operator stops pressing the operation member 30, energization is stopped.

Figure 2:
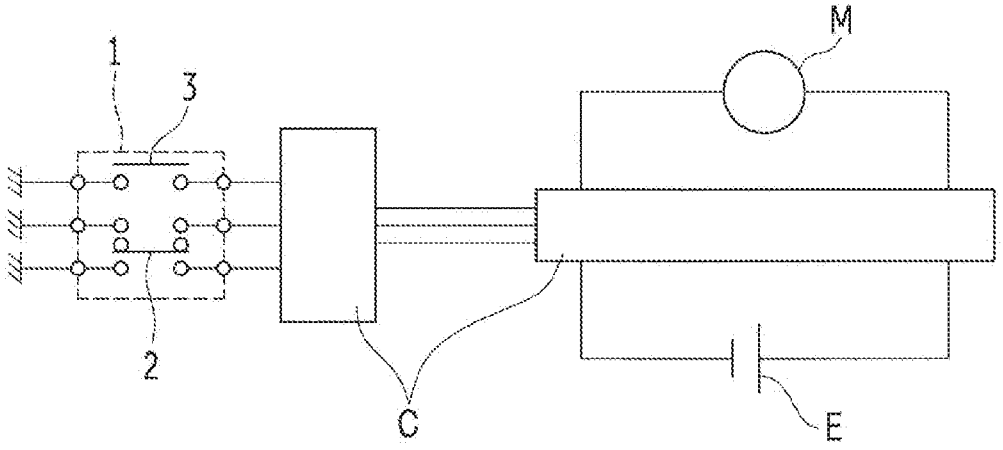
FIG. 2 is a schematic circuit diagram illustrating a simplified example of part of the circuit configuration regarding the switch device described in the present application.

The change-over switch 2 is a switch operated by a user of the electric motor device. The change-over switch 2 includes a swing member 20 that swings in response to operation performed by the user (from outside), a contact member 21, and a substrate 22. The swing member 20 is a member such as a change-over lever that receives operation performed by the user. If the user operates the swing member 20, power supplied to the power load M is changed over. For example, in a case where the change-over switch 2 is used in the switch device 1 of the electric motor device, the change-over switch 2 can be configured as follows. If the operation member 30 is pressed while the swing member 20 has moved to a first side, the electric motor, which is the power load M of the electric motor device, rotates in the normal direction. If the operation member 30 is depressed while the swing member 20 has moved to a second side different from the first side, the electric motor rotates in the reverse direction. Details of the change-over switch 2 will be described later, FIG. 2 is a schematic circuit diagram illustrating a simplified example of part of the circuit configuration regarding the switch device 1 described in the present application. The circuit section 4 includes a circuit which is opened/closed or brought into contact with/separated by the power source switch 3 and the change-over switch 2. FIG. 2 illustrates part of the circuit included in the circuit section 4 in association with part of the circuit of the electric motor device, In FIG. 2, a portion indicated by broken lines schematically illustrates part of the circuit incorporated in the switch device 1, and it is possible to electrically connect the circuit in the switch device 1 to the power load M in the electric motor device. The electric motor device includes, in addition to the switch device 1, an electric motor that functions as the power load M, a motor control circuit C that functions as a load-side circuit which controls the electric motor, and a power source E that supplies electric power to the electric motor (may also be a power source cord that receives electric power supplied from outside). The power source switch 3 opens and closes a ground terminal and a power source-side terminal electrically connected to the motor control circuit C. By opening and closing the ground terminal and the power source-side terminal on the basis of operation of the power source switch 3, the energization state to a switch element such as a transistor incorporated in the motor control circuit C is controlled. The power load M is switched on/off by controlling the energization state to the switch element. The change-over switch 2 can change over a circuit formed between the ground terminal and the load-side terminal electrically connected to the motor control circuit C. According to changeover between the ground terminal and the load-side terminal based on the operation of the change-over switch 2, the configuration of the circuit incorporated in the motor control circuit C is changed over. As a result of the changeover of the circuit configuration of the motor control circuit C, for example, the rotation direction of the electric motor is changed over.

As described, the power source switch 3 opens and closes the ground terminal and the power source-side terminal that supplies electric power to the power load M. The change-over switch 2 opens and closes the ground terminal and the load-side terminal connected to the power load M. Note that there are two pairs of the ground terminals and the load-side terminals that are opened/closed by the change-over switch 2, and the ground terminal and the load-side terminal of either one pair of the two pairs of terminals are closed by operating the change-over switch 2. Therefore, the operator can operate the electric motor device by performing change-over operation of connecting the change-over switch 2 to any one of the terminal pairs and closing the power source switch 3 to rotate the electric motor in the normal direction or the reverse direction.

Figure 3A:
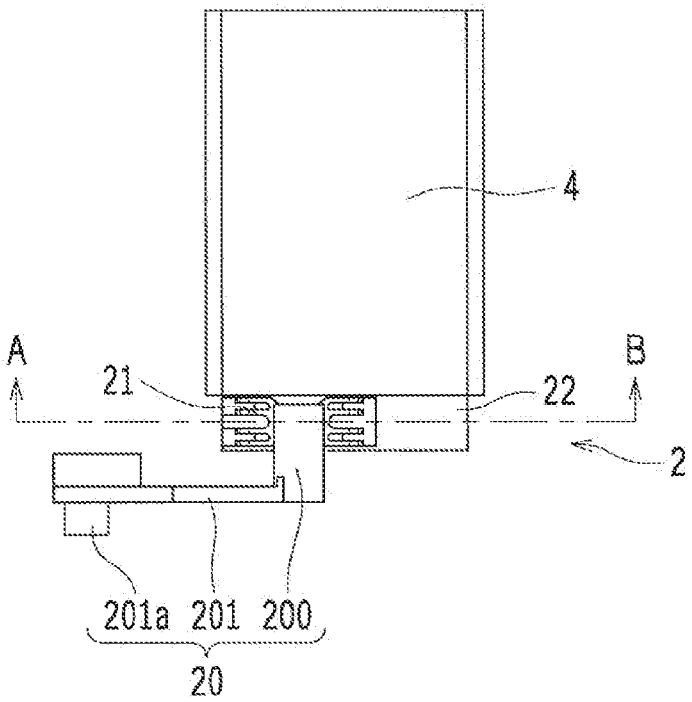
FIG. 3A is a schematic external view illustrating an example of the external appearance of a change-over switch described in the present application.
Figure 3B:
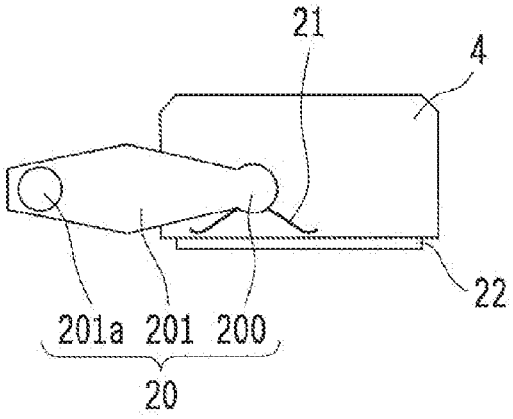
FIG. 3B is a schematic external view illustrating an example of the external appearance of the change-over switch described in the present application.

Next, the configuration of the change-over switch 2 will be described. FIGS. 3A and 3B are schematic external views illustrating an example of the external appearance of the change-over switch 2 described in the present application. FIG. 3A is a schematic plan view, and FIG. 3B is a schematic front view. In each of FIGS. 3A and 3B, the circuit section 4 is also illustrated in order to facilitate understanding of the relationship with FIG. 1. Note that in the following description, with respect to the directions of the change-over switch 2, in FIG. 3A, it is assumed that the front side is the top, the back side is the bottom, the lower side is the front (front side), and the upper side is the rear. However, these directions are used for the sake of explanation and do not limit the directions when the change-over switch 2 is used. As described above, the change-over switch 2 includes the swing member 20, the contact member 21, and the substrate 22.

Figure 4A:
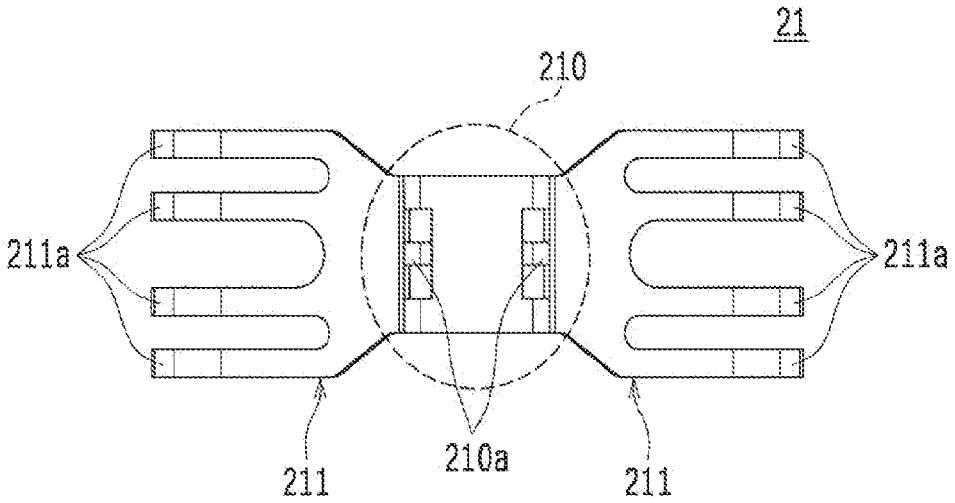
FIG. 4A is a schematic external view illustrating an example of the external appearance of a contact member included in the change-over switch described in the present application.
Figure 4B:
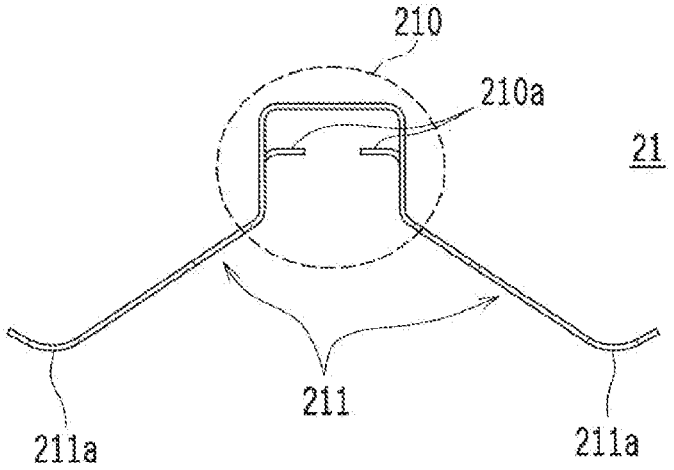
FIG. 4B is a schematic external view illustrating an example of the external appearance of the contact member included in the change-over switch described in the present application.
Figure 5:
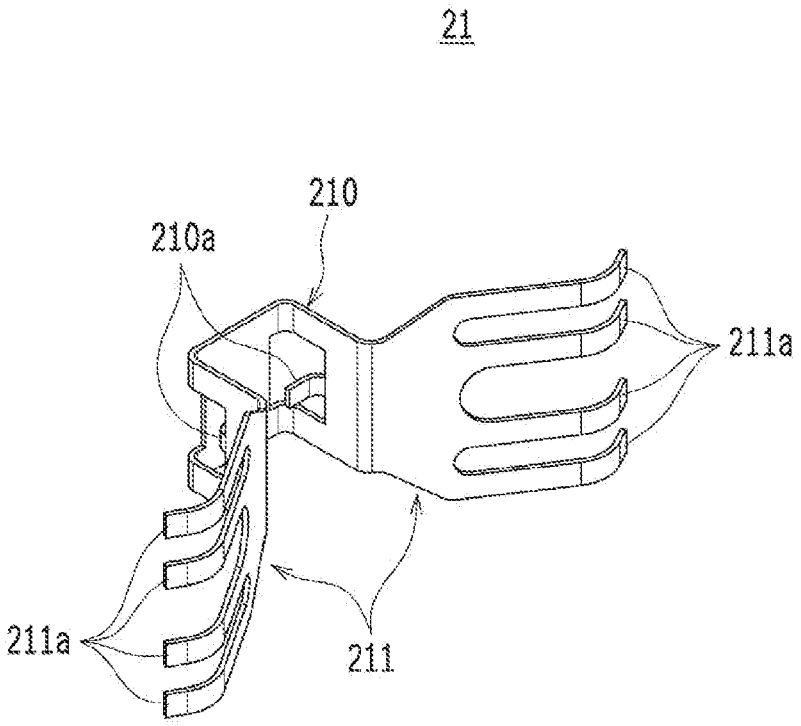
FIG. 5 is a schematic perspective view illustrating an example of the external appearance of the contact member included in the change-over switch described in the present application.

The swing member 20 included in the change-over switch 2 is formed by molding a resin such as a thermoplastic resin or a thermosetting resin by a molding method such as injection molding. The swing member 20 includes a shaft portion 200 having a columnar shape whose central axis is the swing axis. On the bottom surface on the front side of the shaft portion 200 having the columnar shape of the swing member 20, an operation arm 201 having an elongated substantially hexagonal plate shape is formed. In the mode illustrated in FIGS. 3A and 3B, the swing member 20 is disposed so that the axial direction of the shaft portion 200 is the front-rear direction, and the operation arm 201 extends to the left from the bottom surface on the front surface side. The operation arm 201 which has an elongated shape has an end portion on a first side (right side) integrated with the bottom surface of the shaft portion 200. A protrusion 201*a* which receives operation of the operator is provided so as to project from a second side (left side) different from the first side. If the operator operates the protrusion 201*a*, the swing member 20 swings about the swing axis. In the schematic front view illustrated in FIG. 3B, if the operator moves the protrusion 201*a* up and down, the swing member 20 swings about the swing axis passing through the center of the shaft portion 200, FIGS. 4A and 4B are schematic external views illustrating an example of the external appearance of the contact member 21 included in the change-over switch 2 described in the present application. FIG. 4A is a schematic plan view, and FIG. 4B is a schematic front view, FIG. 5 is a schematic perspective view illustrating an example of the external appearance of the contact member 21 included in the change-over switch 2 described in the present application. The contact member 21 included in the change-over switch 2 is formed, for example, by punching out a conductive thin metal plate made of copper, iron, or the like and bending the conductive thin metal plate. The contact member 21 includes a flexing portion 210 that is bent at substantially right angles at two spots, and movable contacts 211 that extend in different directions from the flexing portion 210, The vicinity of the front end of each of the movable contacts 211 extending from the flexing portion 210 swings to contact the substrate 22.

The flexing portion 210 is located near the center of the contact member 21. The flexing portion 210 has two corner portions that are bent at substantially right angles as viewed from the front, and is formed in a frame shape with one side missing. More specifically, the flexing portion 210 includes a horizontal frame and a pair of vertical frames extending downward from both ends of the horizontal frame, and has a rectangular frame shape with the lower frame missing, At locations facing each other in both the vertical frames, cut-and-raised portions 210*a* cut and raised toward the other vertical frame are formed. Since the cut-and-raised portions 210*a* are cut and raised at right angles and are substantially parallel to the horizontal frame, the cut-and-raised portions 210*a* extend so as to be positioned on substantially the same straight line. That is, the flexing portion 210 of the contact member 21 and the cut-and-raised portions 210*a* together form a frame-shaped portion having a substantially rectangular frame shape. The frame-shaped portion formed by the flexing portion 210 and the cut-and-raised portions 210*a* is disposed inside the shaft portion 200 of the swing member 20.

From both end portions of the flexing portion 210, that is, the portions corresponding to the lower ends of both the vertical frames, the movable contacts 211 extend obliquely downward so as to spread. That is, the movable contacts 211 are formed so as to gradually spread obliquely downward from the lower ends of the flexing portion 210. The movable contacts 211 extending obliquely downward to the right and the left from the flexing portion 210 are branched from the middle thereof into four brush pieces 211*a* on each of the both sides, and slidably contact the substrate 22 at each brush piece 211*a*. That is, the movable contacts 211 are in contact with the substrate 22 at the eight brush pieces 211*a*. Note that the front end of the brush piece 211*a* is warped so as to smoothly contact and slide on the substrate 22.

Figure 6:
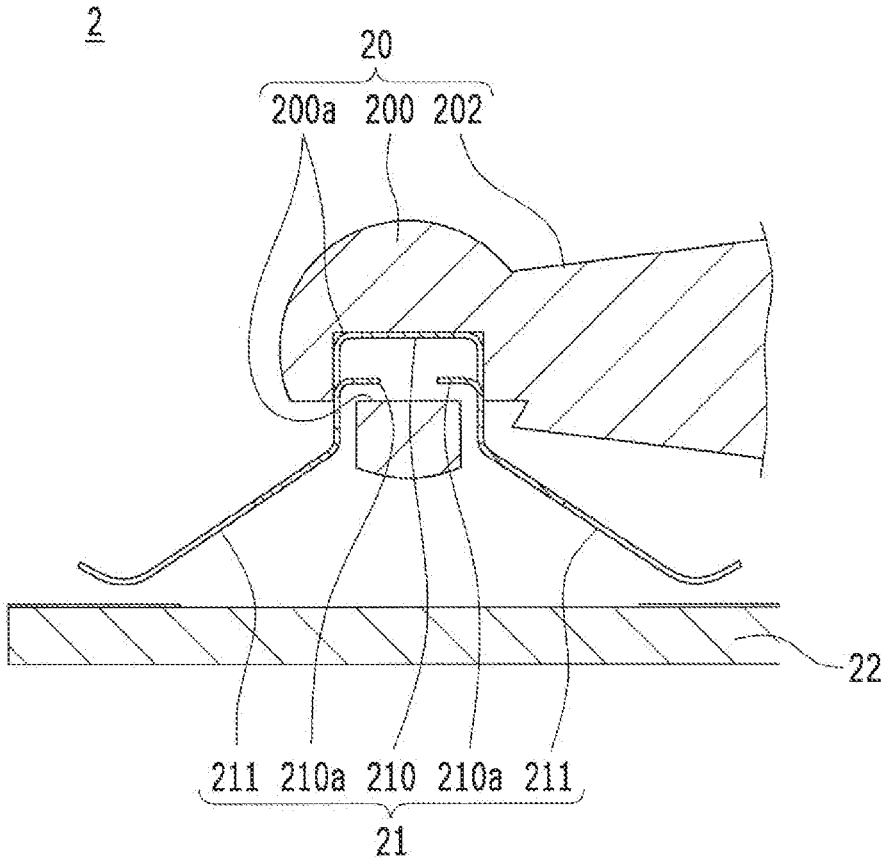
FIG. 6 is a schematic enlarged cross-sectional view illustrating an example of part of the cross section of the change-over switch described in the present application in an enlarged manner.

FIG. 6 is a schematic enlarged cross-sectional view illustrating an example of part of the cross section of the change-over switch 2 described in the present application in an enlarged manner. FIG. 6 is a schematic enlarged cross-sectional view in which the A-B cross section illustrated in FIG. 3A is enlarged so that the relationship between the shaft portion 200 of the swing member 20 and the flexing portion 210 of the contact member 21 can be recognized. Inside the shaft portion 200 of the swing member 20, a holding portion 200a is formed in which a groove into which the flexing portion 210 of the contact member 21 is fitted. The frame-shaped portion formed by the flexing portion 210 and the cut-and-raised portions 210*a* of the contact member 21 is fitted in the holding portion 200*a* of the swing member 20. Thus, the swing member 20 holds a contact member 21. The holding portion 200a has the groove having a substantially rectangular shape as viewed from the front. The frame-shaped portion formed by the flexing portion 210 and the cut-and-raised portions 210*a* of the contact member 21 is fitted into the substantially rectangular groove, and the flexing portion 210 of the contact member 21 is fitted in the groove of the holding portion 200*a*. That is, the holding portion 200*a* of the swing member 20 is fitted onto the frame-shaped portion formed by the flexing portion 210 and the cut-and-raised portions 210*a* of the contact member 21 to hold the contact member 21. By forming the flexing portion 210 and the cut-and-raised portions 210*a* in the contact member 21 to form the frame-shaped portion having a substantially rectangular shape, the holding portion 200*a* having a substantially rectangular shape can hold the contact member 21 in the shaft portion 200. For example, in a case where the cut-and-raised portions 210*a* are not formed in the contact member 21, since the contact member 21 is formed from a thin metal plate, the groove for fitting must be elongated. In a case where the swing member 20 in which a narrow groove for holding the contact member 21 is engraved is formed by injection molding, there is a possibility that the molding cost will increase. However, if the groove engraved in the holding portion 200*a* is not a narrow groove but a rectangular groove, the swing member 20 can be easily molded. Therefore, it is possible to suppress an increase in the molding cost. If the holding portion 200*a* of the swing member 20 having the swing axis as the central axis holds the contact member 21, the contact member 21 is held in a state where the plurality of movable contacts 211 extends in different directions from the swing axis. The plurality of movable contacts 211 extending in different directions from the swing axis herein means that the angle formed between the extending direction of the movable contact 211 and the swing axis differs for each movable contact 211.

Figure 7:
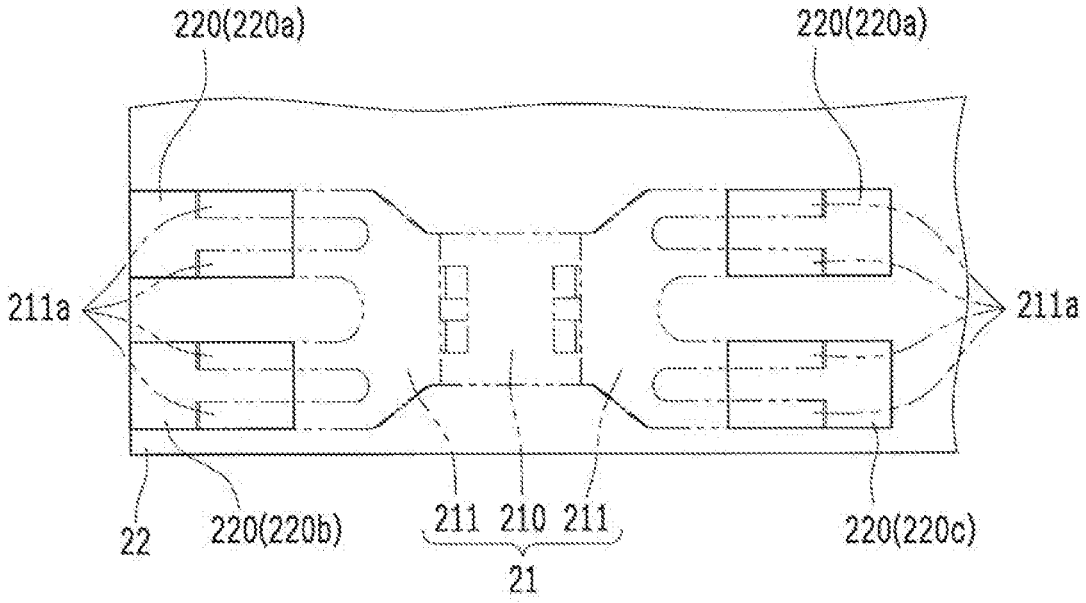
FIG. 7 is a schematic external view illustrating an example of the change-over switch described in the present application.

FIG. 7 is a schematic external view illustrating an example of the change-over switch 2 described in the present application. FIG. 7 is a schematic plan view. In order to facilitate understanding of the relationship between the substrate 22 and the contact member 21, FIG. 7 is a transparent view in which part of the swing member 20 and the outer shape of the contact member 21 are indicated by alternate long and two short dashed lines. A fixed contact 220 that the movable contact 211 of the contact member 21 can contact is formed on the upper surface of the substrate 22. In the example of FIG. 7, as the fixed contact 220, two ground fixed contacts 220*a* having a rectangular shape whose long side direction is the right-left direction are formed on the back side, and a normal rotation fixed contact 220*b* and a reverse rotation fixed contact 220*c* having a rectangular shape whose long side direction is the right-left direction are formed on the front side. Note that here the description will be given assuming that the normal rotation fixed contact 220*b* is located on the front left side and the reverse rotation fixed contact 220*c* is located on the front right side. The ground fixed contacts 220a are electrically connected to the ground terminals. The normal rotation fixed contact 220*b* is electrically connected to the load-side terminal on the normal rotation side, and the reverse rotation fixed contact 220*c* is electrically connected to load-side terminal on the reverse rotation side.

Adjacent two brush pieces 211*a* of the eight brush pieces 211*a* included in the contact member 21 form a pair and contact the fixed contact 220 on the substrate 22. In the contact member 21 illustrated in FIG. 7, the two pairs of brush pieces 211*a* on the back side can contact the ground fixed contacts 220*a*, respectively. The pair of brush pieces 211*a* on the front left side can contact the normal rotation fixed contact 220*b*, and the pair of brush pieces 211*a* on the front right side can contact the reverse rotation fixed contact 220*c*.

Figure 8A:
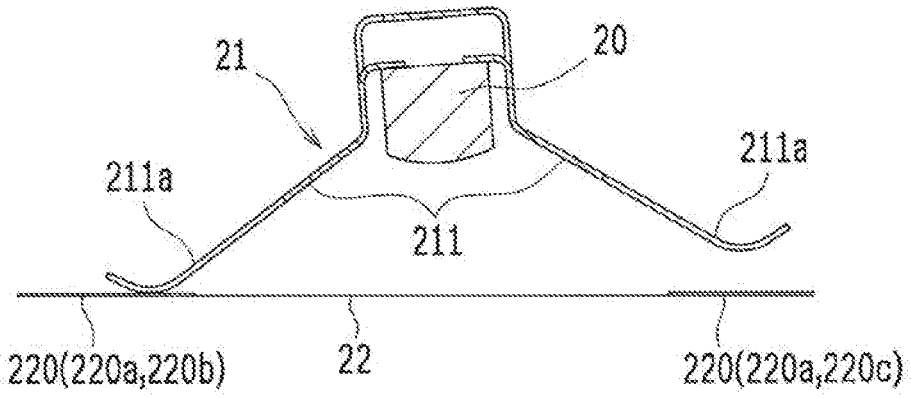
FIG. 8A is a schematic enlarged cross-sectional view illustrating an example of part of the cross section of the change-over switch described in the present application in an enlarged manner.
Figure 8B:
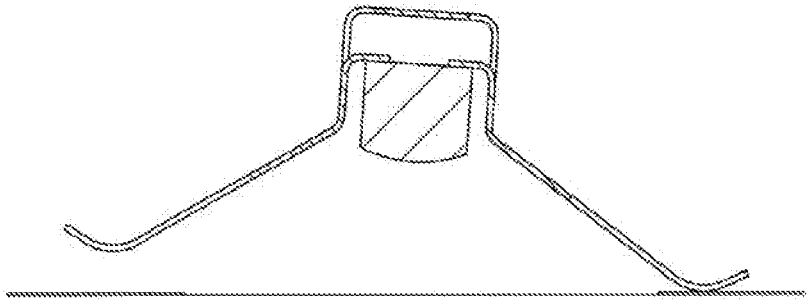
FIG. 8B is a schematic enlarged cross-sectional view illustrating an example of the external appearance of the change-over switch described in the present application in an enlarged manner.
Figure 8C:
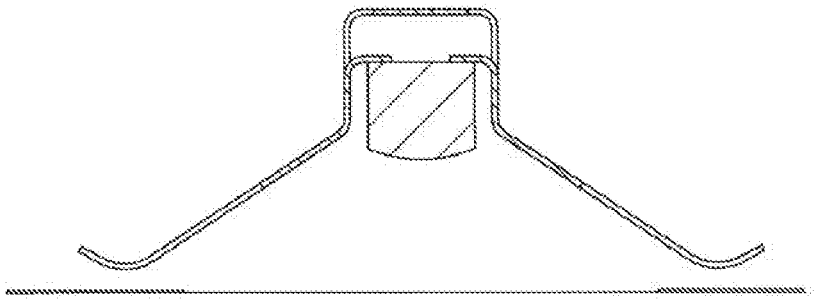
FIG. 8C is a schematic enlarged cross-sectional view illustrating an example of part of the cross section of the change-over switch described in the present application in an enlarged manner.

Next, the operation of the change-over switch 2 described in the present application will be described. FIGS. 8A, 8B, and 8C are schematic enlarged cross-sectional views illustrating an example of the cross section of part of the change-over switch 2 described in the present application. FIGS. 8A, 8B, and 80 illustrate the operation of the change-over switch 2 as viewed from the front, Note that the schematic enlarged cross-sectional views are used so that the position of the contact member 21 can be easily grasped. FIG. 8A illustrates a state where the operation arm 201 (the operation arm 201 is not illustrated) of the swing member 20 extending to the left as viewed from the front swings downward. If the operation arm 201 of the swing member 20 swings downward, the swing member 20 swings to the left (counterclockwise) as viewed from the front, and the swing member 20 in the entirety inclines upward to the right. If the swing member 20 swings, the contact member 21 that moves in conjunction with the swing member 20 such that the swing axis thereof is identical to the swing axis of the swing member also swings to the left. If the contact member 21 swings to the left, the movable contact 211 on the left side of the contact member 21 contacts the fixed contact 220 on the left side on the substrate 22. The brush piece 211*a* included in the movable contact 211 contacts the fixed contact 220 along with swinging of the contact member 21. If the contact member 21 further swings, the brush piece 211*a* slides on the fixed contact 220 in a state where the brush piece 211*a* is pressed against the fixed contact 220. The contact member 21 is formed from a thin metal plate. Therefore, if the contact member 21 is pressed against the fixed contact 220, the brush piece 211*a* slides on the fixed contact 220 while the brush piece 211*a* is warped and in contact with the fixed contact 220. As described, if the movable contact 211 contacts the fixed contact 220 and then is pressed against the fixed contact, the movable contact 211 and the fixed contact 220 can be reliably brought into contact with each other. Furthermore, since the movable contact 211 slides in contact with the fixed contact 220, removal of foreign matter on the fixed contact 220 can be expected. Note that in the state of FIG. 8A, since the brush pieces 211*a* of the movable contact 211 contact the ground fixed contact 220*a* and the normal rotation fixed contact 220*b* on the left side, the ground fixed contact 220*a* and the normal rotation fixed contact 220*b* on the left side are electrically connected to each other. Therefore, the ground terminal and the load-side terminal on the normal rotation side are brought into a conductive state. If the operation member 30 of the power source switch 3 is pressed in this state, the electric motor provided as the power load M in the electric motor device is energized in the normal rotation direction, and the electric motor rotates in the normal direction.

FIG. 8B illustrates a state in which the operation arm 201 of the swing member 20 swings upward. If the operation arm 201 of the swing member 20 swings upward, the swing member 20 swings to the right (clockwise) as viewed from the front, and the swing member 20 in the entirety inclines downward to the right. If the swing member 20 swings, the contact member 21 that moves in conjunction with the swing member 20 such that the swing axis thereof is identical to the swing axis of the swing member also swings to the right. If the contact member 21 swings to the right, the movable contact 211 on the right side of the contact member 21 contacts the fixed contact 220 on the right side on the substrate 22. Note that in the state of FIG. 8B, since the brush pieces 211*a* of the movable contact 211 contact the ground fixed contact 220*a* and the reverse rotation fixed contact 220*c* on the right side, the ground fixed contact 220*a* and the reverse rotation fixed contact 220*c* on the right side are electrically connected to each other. Therefore, the ground terminal and the load-side terminal on the reverse rotation side are brought into a conductive state. If the operation member 30 of the power source switch 3 is pressed in this state, the electric motor provided as the power load M in the electric motor device is energized in the reverse rotation direction, and the electric motor rotates in the reverse direction.

FIG. 8C illustrates a state where the swing member 20 is kept substantially horizontal. As illustrated in FIG. 8C, if the swing member 20 is substantially horizontal, the movable contacts 211 of the contact member 21 are kept in a state of being separated from the fixed contacts 220. The switch device 1 described in the present application can be in a locked state where the power source switch 3 is mechanically prevented from being pressed, for example. In a case where the power source switch 3 is in the locked state, swinging of the swing member 20 is also prevented in conjunction with a lock mechanism of the power source switch 3. For example, if swinging of the swing member 20 in conjunction with the lock mechanism of the power source switch 3 is prevented, the state is fixed to the state illustrated in FIG. 80.

Second Embodiment

The second embodiment is different from the first embodiment in the shape and function of various members included in a change-over switch 2. Note that in the following description, a same configuration as that in the first embodiment will be denoted by the same reference numeral as that in the first embodiment, the first embodiment will be referred to, and the description will be partially omitted.

Figure 9:
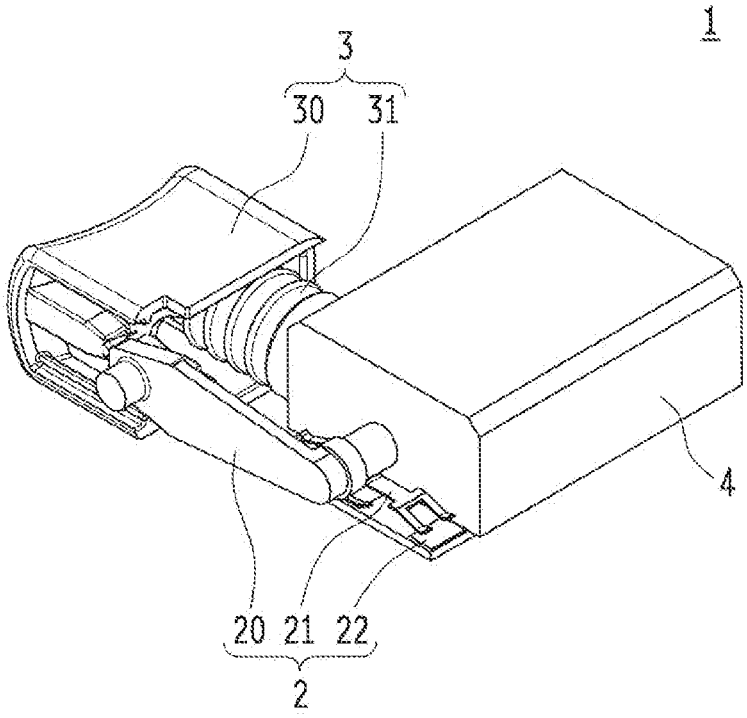
FIG. 9 is a schematic perspective view illustrating an example of the external appearance of a switch device described in the present application.

FIG. 9 is a schematic perspective view illustrating an example of the external appearance of a switch device 1 described in the present application. The switch device 1 illustrated in FIG. 9 includes a change-over switch 2, a power source switch 3, a circuit section 4, and the like.

Figure 10:
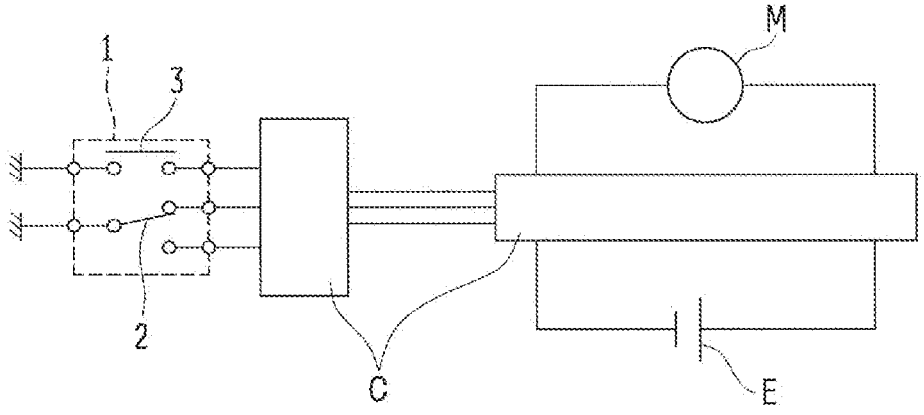
FIG. 10 is a schematic circuit diagram illustrating a simplified example of part of the circuit configuration regarding the switch device described in the present application.

FIG. 10 is a schematic circuit diagram illustrating a simplified example of part of the circuit configuration of the switch device 1 described in the present application. The circuit section 4 includes a circuit which is opened/closed or brought into contact with/separated by the power source switch 3 and the change-over switch 2. FIG. 10 illustrates part of the circuit included in the circuit section 4 in association with part of the circuit of an electric motor device. In FIG. 10, a portion indicated by broken lines schematically illustrates part of the circuit incorporated in the switch device 1, and it is possible to electrically connect the circuit in the switch device 1 to a power load M in the electric motor device. The power source switch 3 opens and closes a ground terminal and a power source-side terminal that supplies electric power to the power load M. The change-over switch 2 opens and closes the ground terminal and the load-side terminal connected to the power load M. Two terminals are provided as the load-side terminals. By operating the change-over switch 2, it is possible to connect and disconnect the ground terminal and either one of the two load-side terminals. Note that it is also possible to fix the change-over switch 2 to a neutral state where the ground terminal is not connected to any of the load-side terminals.

Figure 11A:
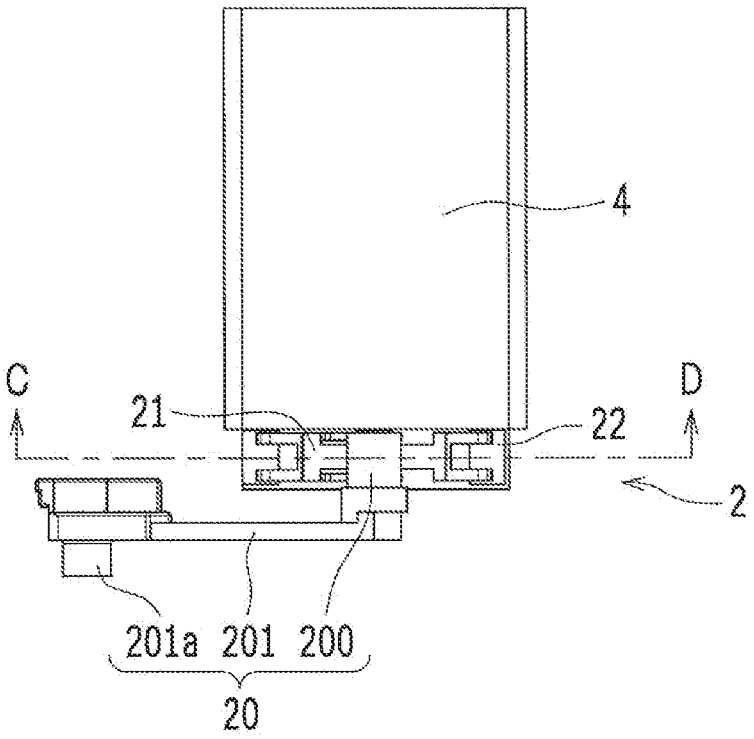
FIG. 11A is a schematic external view illustrating an example of the external appearance of the change-over switch described in the present application.
Figure 11B:
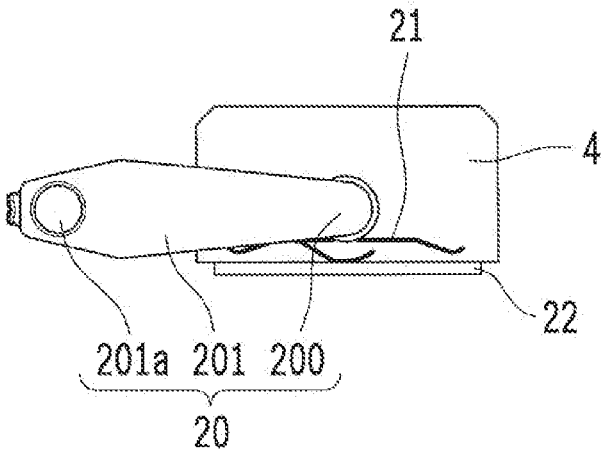
FIG. 11B is a schematic external view illustrating an example of the external appearance of the change-over switch described in the present application.

Next, the configuration of the change-over switch 2 will be described. FIGS. 11A and 11B are schematic external views illustrating an example of the external appearance of the change-over switch 2 described in the present application. FIG. 11A is a schematic plan view, and FIG. 11 B is a schematic front view. In each of FIGS. 11A and 11B, the circuit section 4 is also illustrated in order to facilitate understanding of the relationship with FIG. 9. As described above, the change-over switch 2 includes a swing member 20, a contact member 21, and a substrate 22. The swing member 20 included in the change-over switch 2 includes a shaft portion 200 having a cylindrical shape, and an operation arm 201 having a substantially hexagonal plate shape is formed on one bottom surface of the shaft portion 200.

Figure 12A:
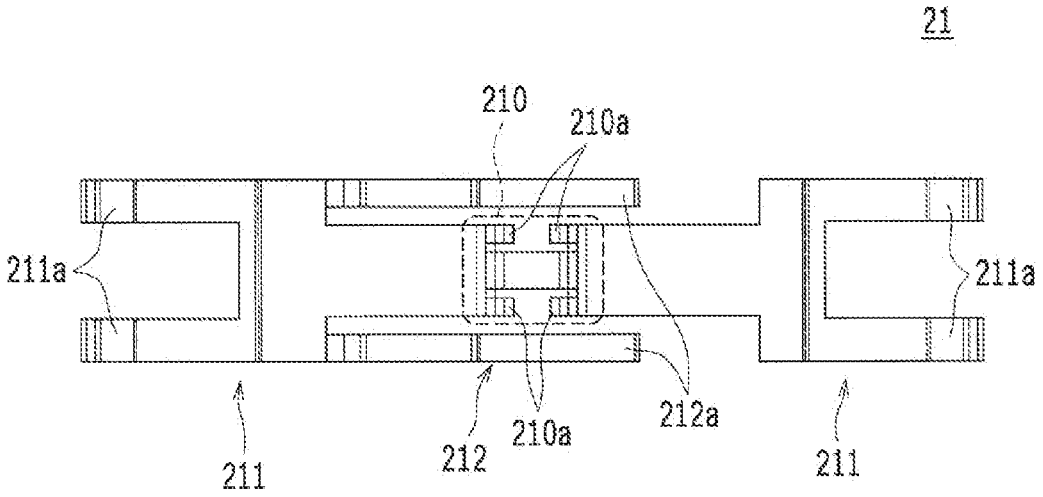
FIG. 12A is a schematic external view illustrating an example of the external appearance of a contact member included in the change-over switch described in the present application.
Figure 12B:
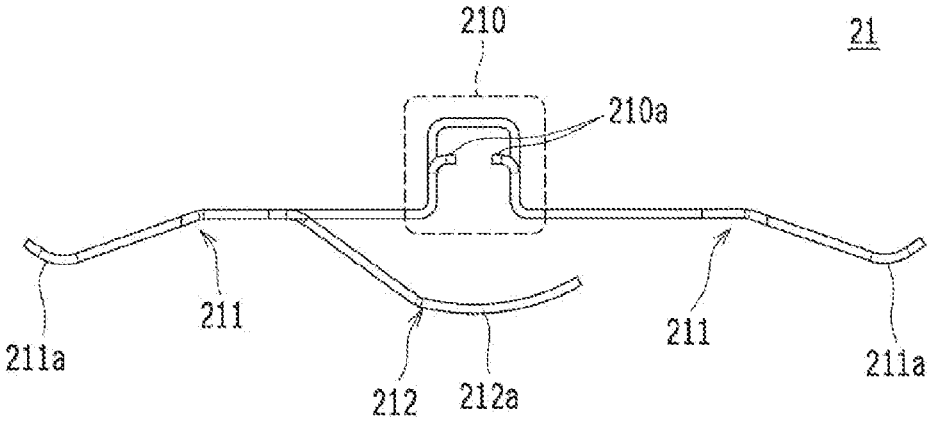
FIG. 12B is a schematic external view illustrating an example of the external appearance of the contact member included in the change-over switch described in the present application.
Figure 13:
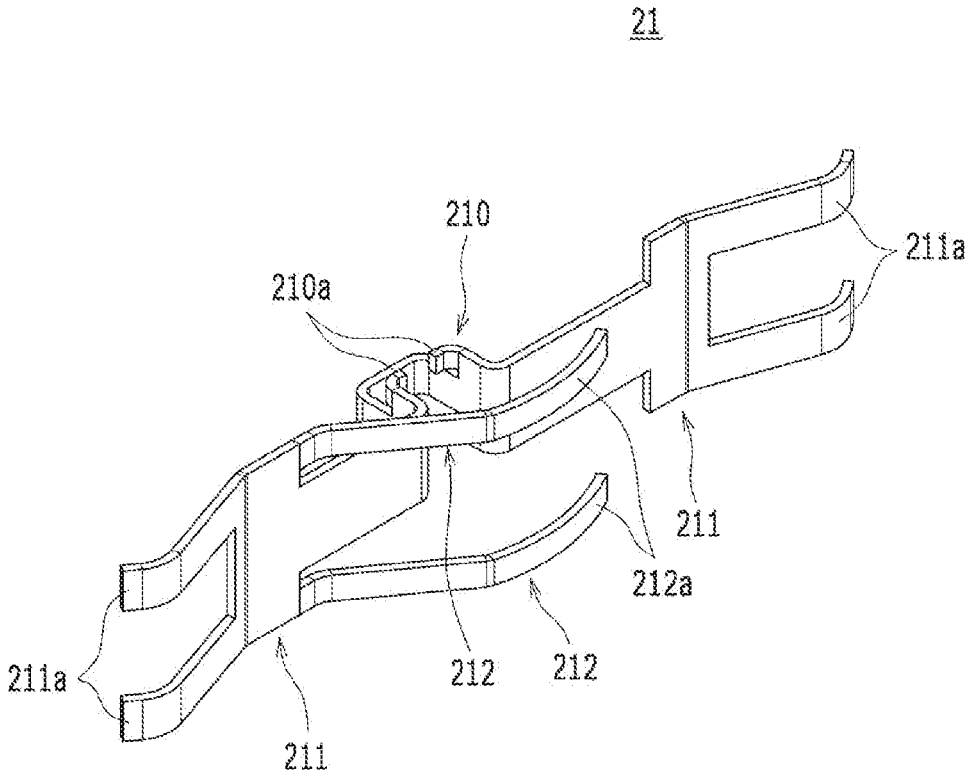
FIG. 13 is a schematic perspective view illustrating an example of the external appearance of the contact member included in the change-over switch described in the present application.

FIGS. 12A and 12B are schematic external views illustrating an example of the external appearance of the contact member 21 included in the change-over switch 2 described in the present application. FIG. 12A is a schematic plan view, and FIG. 12B is a schematic front view. FIG. 13 is a schematic perspective view illustrating an example of the external appearance of the contact member 21 included in the change-over switch 2 described in the present application. The contact member 21 includes a flexing portion 210 that is bent at substantially right angles at two spots, and movable contacts 211 that extend in different directions from the flexing portion 210. The movable contacts 211 extend to the right and the left from the flexing portion 210 and then extend obliquely downward. The vicinity of the front end of each of the movable contacts 211 swings to contact the substrate 22. A constant contact 212 extending obliquely to the lower right is branched from the middle of the movable contact 211 extending to the left. A front end of the constant contact 212 is formed as a brush piece 212*a*, and is kept in contact with the substrate 22 regardless of the swinging state of the contact member 21.

The flexing portion 210 is located near the center of the contact member 21. The flexing portion 210 has two corner portions that are bent at substantially right angles as viewed from the front, and is formed in a frame shape with one side missing. At locations facing each other in both vertical frames, cut-and-raised portions 210*a* cut and raised toward the other vertical frame are formed, That is, the flexing portion 210 of the contact member 21 and the cut-and-raised portions 210*a* together form a frame-shaped portion having a substantially rectangular frame shape. The frame-shaped portion formed by the flexing portion 210 and the cut-and-raised portions 210*a* is disposed inside the shaft portion 200 of the swing member 20.

From both end portions of the flexing portion 210, that is, portions corresponding to the lower ends of both the vertical frames, movable contacts 211 extend to the right and the left so as to spread and further extend obliquely downward. That is, the movable contacts 211 are formed so as to gradually spread diagonally downward from the lower ends of the flexing portion 210. From the middle of the movable contact 211 on a first side, the constant contact 212 is branched toward a second side different from the first side. FIG. 12A, 12B, and 13 illustrate a case where the constant contact 212 extending obliquely to the lower right is branched from the middle of the movable contact 211 extending to the left. The front ends of the respective contacts, that is, the movable contacts 211 and the constant contact 212, are brush pieces 211*a* that slidably contact the substrate 22, The movable contact 211 has two brush pieces 211*a* on the front end side. The constant contact 212 has two brush pieces 211*a* formed from the root thereof branched from the movable contact 211.

Figure 14:
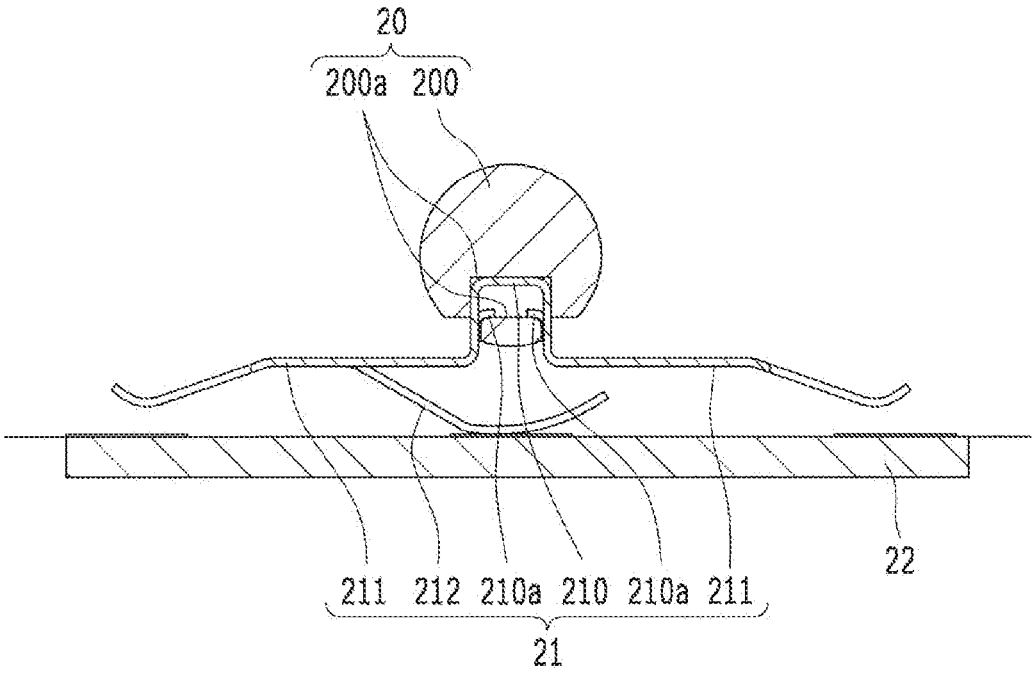
FIG. 14 is a schematic enlarged cross-sectional view illustrating an example of part of the cross section of the change-over switch described in the present application in an enlarged manner.

FIG. 14 is a schematic enlarged cross-sectional view illustrating an example of part of the cross section of the change-over switch 2 described in the present application in an enlarged manner. FIG. 14 is a schematic enlarged cross-sectional view in which the C-D cross section illustrated in FIG. 11A is enlarged so that the relationship between the shaft portion 200 of the swing member 20 and the flexing portion 210 of the contact member 21 can be recognized. Inside the shaft portion 200 of the swing member 20, a holding portion 200*a* is formed in which a groove into which the flexing portion 210 of the contact member 21 is fitted. The frame-shaped portion formed by the flexing portion 210 and the cut-and-raised portions 210*a* of the contact member 21 is fitted in the holding portion 200*a* of the swing member 20. Thus, the swing member 20 holds a contact member 21. The holding portion 200*a* has the groove having a substantially rectangular shape as viewed from the front. The frame-shaped portion formed by the flexing portion 210 and the cut-and-raised portions 210*a* of the contact member 21 is fitted into the substantially rectangular groove, and the flexing portion 210 of the contact member 21 is fitted in the groove of the holding portion 200*a*. That is, the holding portion 200*a* of the swing member 20 is fitted onto the frame-shaped portion formed by the flexing portion 210 and the cut-and-raised portions 210*a* of the contact member 21 to hold the contact member 21.

Figure 15:
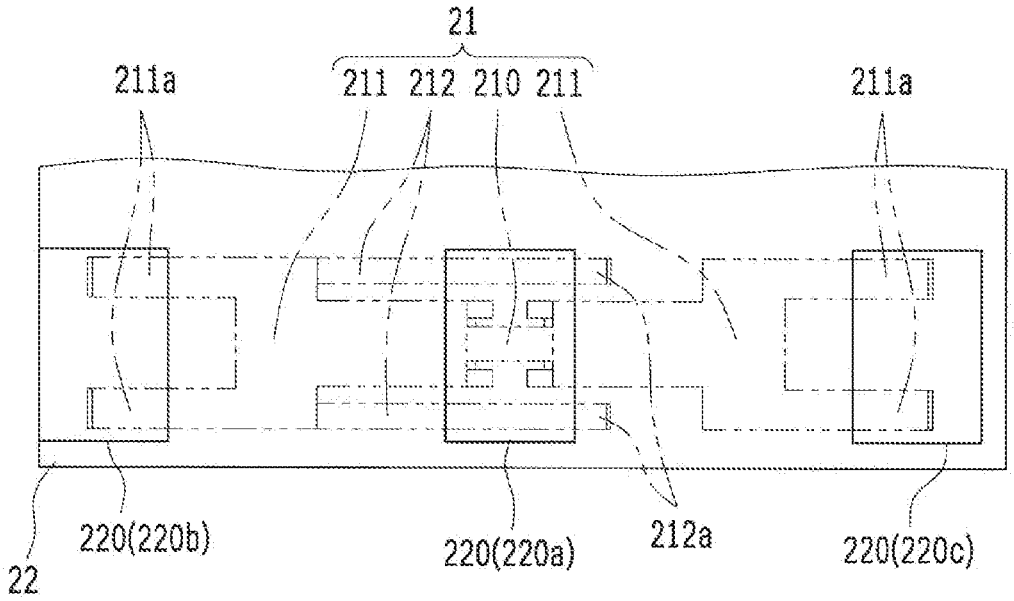
FIG. 15 is a schematic external view illustrating an example of the change-over switch described in the present application.

FIG. 15 is a schematic external view illustrating an example of the change-over switch 2 described in the present application. FIG. 15 is a schematic plan view. In order to facilitate understanding of the relationship between the substrate 22 and the contact member 21, FIG. 15 is a transparent view in which part of the swing member 20 and the outer shape of the contact member 21 are indicated by alternate long and two short dashed lines. A fixed contact 220 that the movable contact 211 of the contact member 21 can contact is formed on the upper surface of the substrate 22. In the example of FIG. 15, as the fixed contact 220, a ground fixed contact 220*a* having a rectangular shape whose long side direction is a front-back direction is formed on the center, a normal rotation fixed contact 220*b* having a rectangular shape whose long side direction is the front-back direction is formed on the left side, and a reverse rotation fixed contact 220*c* having a rectangular shape whose long side direction is the front-back direction is formed on the right side.

Two brush pieces 211*a* formed on the contact member 21 form a pair and contact the fixed contact 220 on the substrate 22. In the contact member 21 illustrated in FIG. 15, the brush pieces 211*a* of the movable contact 211 on the left side can contact the normal rotation fixed contact 220*b*, and the brush pieces 211*a* of the movable contact 211 on the right side can contact the reverse rotation fixed contact 220*c*, In addition, the brush pieces 212*a* of the constant contact 212 contacts the ground fixed contact 220*a*. The constant contact 212 is in contact with the ground fixed contact 220*a* regardless of the swinging state of the contact member 21. Therefore, the movable contacts 211 of the contact member 21 and the ground fixed contact 220*a* formed on the substrate 22 are electrically connected by the constant contact 212 regardless of the swinging state of the contact member 21.

Figure 16A:
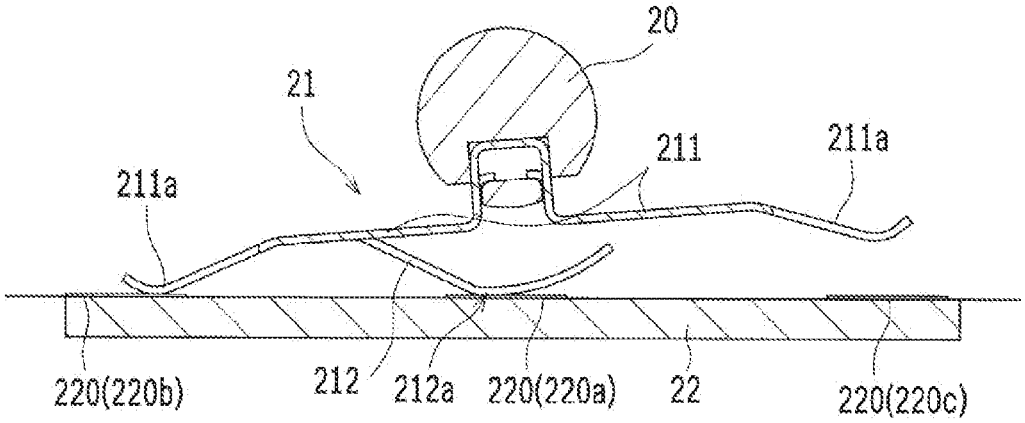
FIG. 16A is a schematic enlarged cross-sectional view illustrating an example of the cross section of part of the change-over switch described in the present application in an enlarged manner.
Figure 16B:
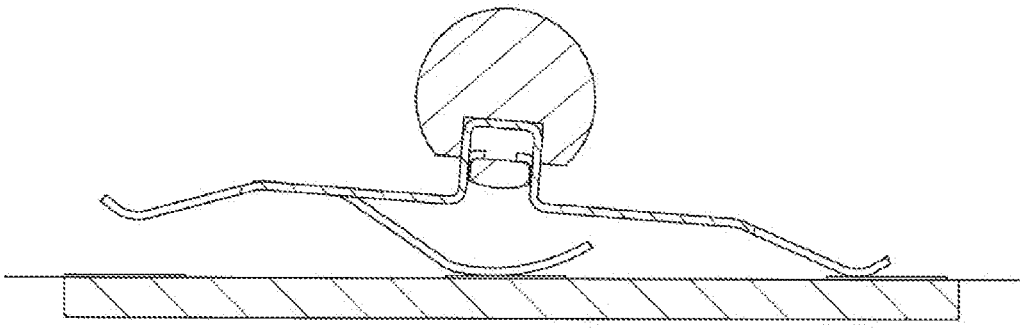
FIG. 16B is a schematic enlarged cross-sectional view illustrating an example of the cross section of part of the change-over switch described in the present application in an enlarged manner.
Figure 16C:
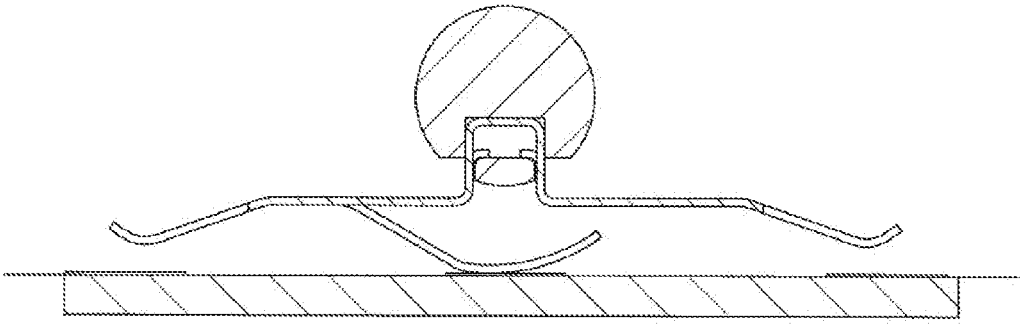
FIG. 16C is a schematic enlarged cross-sectional view illustrating an example of part of the cross section of the change-over switch described in the present application in an enlarged manner.

Next, the operation of the change-over switch 2 described in the present application will be described. FIGS. 16A, 16B, and 16C are schematic enlarged cross-sectional views illustrating an example of the cross section of part of the change-over switch 2 described in the present application in an enlarged manner. FIGS. 16A, 16B, and 16C illustrate the operation of the change-over switch 2 as viewed from the front. Note that the schematic enlarged cross-sectional views are used so that the position of the contact member 21 can be easily grasped. FIG. 16A illustrates a state where the operation arm 201 of the swing member 20 swings downward on the left side as viewed from the front. If the operation arm 201 of the swing member 20 swings downward, the swing member 20 swings to the left as viewed from the front, and the swing member 20 in the entirety inclines upward to the right. If the swing member 20 swings, the contact member 21 that moves in conjunction with the swing member 20 such that the swing axis thereof is identical to the swing axis of the swing member also swings to the left. If the contact member 21 swings to the left, the movable contact 211 on the left side of the contact member 21 contacts the fixed contact 220 on the left side on the substrate 22. The constant contact 212 of the contact member 21 is kept in contact with the fixed contact 220 on the center on the substrate 22. In a case where the contact member 21 swings, the constant contact 212 slides in contact with the fixed contact 220. In FIG. 16A, since the brush pieces 211*a* of the movable contact 211 on the left side contact the normal rotation fixed contact 220*b* in a state where the brush pieces 212*a* of the constant contact 212 are in contact with the ground fixed contact 220*a*, the ground fixed contact 220*a* and the normal rotation fixed contact 220*b* are electrically connected to each other. Therefore, the ground terminal and the load-side terminal on the normal rotation side are brought into a conductive state. If the operation member 30 of the power source switch 3 is pressed in this state, the electric motor provided as the power load M in the electric motor device is energized in the normal rotation direction, and the electric motor rotates in the normal direction.

FIG. 16B illustrates a state where the operation arm 201 of the swing member 20 swings upward. If the operation arm 201 of the swing member 20 swings upward, the swing member 20 swings to the right as viewed from the front, and the swing member 20 in the entirety inclines downward to the right. If the swing member 20 swings, the contact member 21 that moves in conjunction with the swing member 20 such that the swing axis thereof is identical to the swing axis of the swing member also swings to the right. If the contact member 21 swings to the right, the movable contact 211 on the right side of the contact member 21 contacts the fixed contact 220 on the right side on the substrate 22. Note that in FIG. 16B, the brush pieces 211*a* of the movable contact 211 on the right side contact the reverse rotation fixed contact 220*c* in a state where the brush pieces 212*a* of the constant contact 212 are in contact with the ground fixed contact 220*a* on the center. Therefore, the ground fixed contact 220*a* and the reverse rotation fixed contact 220*c* are electrically connected to each other, and the ground terminal and the load-side terminal on the reverse rotation side are brought into a conductive state. If the operation member 30 of the power source switch 3 is pressed in this state, the electric motor provided as the power load M in the electric motor device is energized in the reverse rotation direction, and the electric motor rotates in the reverse direction.

FIG. 16C illustrates a state where the swing member 20 is kept substantially horizontal. As illustrated in FIG. 16C, since the swing member 20 is substantially horizontal, the constant contact 212 of the contact member 21 is in contact with the ground fixed contact 220*a* but the movable contacts 211 of the contact member 21 are kept separated from the fixed contacts 220. The switch device 1 described in the present application can be in a locked state where the power source switch 3 is mechanically prevented from being pressed, for example. In a case where the power source switch 3 is in the locked state, swinging of the swing member 20 is also prevented in conjunction with a lock mechanism of the power source switch 3. For example, if swinging of the swing member 20 is prevented in conjunction with the lock mechanism of the power source switch 3, the state is fixed to the state illustrated in FIG. 16C.

As explained above by describing the first embodiment and the second embodiment as examples, the change-over switch 2 included in the switch device 1 described in the present application includes the swing member 20 configured to swing in response to an operation from the outside, the contact member 21 configured to swing about the swing axis identical to the swing axis of the swing member 20, the contact member 21 including a plurality of movable contacts 211 extending in different directions from one another, and the substrate 22 on which the fixed contact 220 is formed, the fixed contact 220 configured to contact each of the plurality of movable contacts 211 of the contact member 21.

Furthermore, in detail, the switch device 1 described as an example in the first embodiment and the second embodiment includes the change-over switch 2 including members such as the swing member 20, the contact member 21, and the substrate 22. The plurality of fixed contacts 220 are formed on the substrate 22 so as to be located on a virtual parallel plane parallel to the swing axis of the swing member 20. Note that the plurality of fixed contacts 220 is located on the virtual parallel plane; however does not necessarily have to be exactly parallel to the swing member 20, and an error that does not cause a problem in operation is allowed. That is, the parallel relationship here means a substantially parallel relationship including a certain error. In addition, the plurality of fixed contacts 220 is formed on both sides of a virtual orthogonal plane that is orthogonal to the virtual parallel plane and that includes the swing axis of the swing member 20. The first embodiment describes as an example a mode in which the ground fixed contact 220*a* and the normal rotation fixed contact 220*b* are formed on the first side (left side) of the virtual orthogonal plane, and the ground fixed contact 220*a* and the reverse rotation fixed contact 220*c* are formed on the second side (right side). The second embodiment describes as an example a mode in which the normal rotation fixed contact 220*b* is formed on the first side of the virtual orthogonal plane and the reverse rotation fixed contact 220*c* is formed on the second side. Furthermore, the contact member 21 that swings about the swing axis identical to the swing axis of the swing member 20 includes the plurality of movable contacts 211 that extends in different directions with respect to the virtual orthogonal plane. That is, the contact member 21 includes the movable contacts 211 on both sides of the swing axis of the swing member 20. Furthermore, the substrate 22 on which the fixed contacts 220 are formed is orthogonal to the virtual orthogonal plane including the swing axis.

In the change-over switch 2 included in the switch device 1 configured as described above, the movable contact 211 that contacts the fixed contact 220 formed on the substrate 22 is changed over by swinging of the contact member 21 in conjunction with swinging of the swing member 20. That is, it is possible to realize the change-over switch 2 performing different operation in each swinging direction, that is, in each tilting direction of the swing member 20, with a simple configuration of the swing member 20, the contact members 21, and the substrate 22. The change-over switch 2 exhibits excellent effects such as a simplified configuration of components. In particular, in a case where the swing member 20 and the contact member 21 are formed as a single component made by processing a single material, the number of components can be reduced. Reduction of the number of components leads to suppression of soaring costs such as manufacturing cost, assembly cost and management cost.

The present invention is not limited to the embodiments described above, and can be implemented in various other modes. Therefore, the embodiments described above are only examples in all respects, and should not be limitedly interpreted. The technical scope of the present invention is described by the scope of the claims and is not bound by the text of the Description. Furthermore, all modifications and changes belonging to the equivalent scope of the claims are within the scope of the present invention.

For example, arrangement of the fixed contacts 220 described in the above embodiments is only an example, and the arrangement can be changed variously, and arrangement of movable contacts 211 can also be appropriately designed. Furthermore, for example, the above-described embodiments illustrate a mode in which the change-over switch 2 performs changeover between the normal rotation and reverse rotation of the power load M. However, the change-over switch 2 of the present application is not limited to this, and can be applied to various change-over circuits. For example, various modes such as changeover between rapid/slow of the rotation speed of the power load M can be developed. Furthermore, a power load M other than an electric motor can be developed.

Furthermore, the above-described embodiments describe a mode in which one metal thin plate is processed to form the contact member 21; however, the present invention is not limited to this, and it is sufficient that the swing axis of each movable contact 211 is identical to the swing axis of a swing member 20. For example, various modes can be developed such as a mode in which a thin metal plate is used for each movable contact 211, and the thin metal plates are inserted into a shaft portion 200 of a swing member 20.

Furthermore, in the above-described embodiments, the contact member 21 including the flexing portion 210 formed by bending two spots at right angles into a frame shape is described as an example; however, there may be one bent portion or three or more bent portions, In a case where there is only one bent portion, both sides of the bent portion become both ends of a flexing portion 210, and movable contacts 211 extend from the flexing portion. Furthermore, in a case where the number of bent portions is three or more, both end portion sides of the plurality of bent portions become both ends of a flexing portion 210, and the movable contacts 211 extend from the both ends.

Furthermore, the above-described embodiments illustrate a mode in which the movable contact 211 and the fixed contact 220 are electrically connected by maintaining the state where the brush-shaped constant contact 212 is kept in contact with the fixed contact 220. However, the present invention is not limited to this. For example, it is possible to develop various modes such as providing as internal wiring a constant contact 212 that electrically connects a movable contact 211 and a fixed contact 220.

Furthermore, the above-described embodiments illustrate a mode in which in the shaft portion 200, the holding portion 200*a* is fitted on the frame-shaped portion formed by the flexing portion 210 and the cut-and-raised portions 210*a*, and thus the swing member 20 holds the contact member 21. However, the present invention is not limited to this. For example, it is possible to develop various modes where a shaft portion 200 is fitted into a frame-shaped portion formed by a flexing portion 210 and cut-and-raised portions 210*a* to hold a contact member 21.

DESCRIPTION OF SYMBOLS

1 switch device
2 change-over switch
20 swing member
200 shaft portion
200*a* holding portion
201 operation arm
21 contact member
210 flexing portion (frame-shaped portion)
210*a* cut-and-raised portion (frame-shaped portion)
211 movable contact
212 constant contact
22 substrate
220 fixed contact
3 power source switch

The invention claimed is:

1. A change-over switch comprising:

a swing member configured to swing about a swing axis in response to an operation from outside;

a contact member configured to swing about the swing axis and including a plurality of movable contacts extending in different directions; and a substrate on which a fixed contact is formed, the fixed contact configured to contact each of the plurality of movable contacts of the contact member, wherein the contact member further comprises a constant contact configured to electrically connect the contact member and the fixed contact regardless of a swinging state of the contact member, and which slides in contact with the fixed contact by swinging of the contact member, and one of the plurality of movable contacts that contacts the fixed contact formed on the substrate is changed over by swinging of the contact member in conjunction with swinging of the swing member.

2. A change-over switch comprising:

a swing member configured to swing about a swing axis in response to an operation from outside;

a substrate including a plurality of fixed contacts located on a parallel plane parallel to the swing axis and formed on both sides of an orthogonal plane orthogonal to the parallel plane and including the swing axis; and a contact member configured to swing about the swing axis and including a plurality of movable contacts extending in different directions, wherein the contact member further comprises a constant contact configured to electrically connect the contact member and the fixed contact regardless of a swinging state of the contact member, and which slides in contact with the fixed contact by swinging of the contact member, and one of the plurality of movable contacts that contacts one of the plurality of fixed contact formed on the substrate is changed over by swinging of the contact member in conjunction with swinging of the swing member.

3. The change-over switch according to claim 1, wherein the contact member is formed from one conductive plate.

4. The change-over switch according to claim 1, wherein the swing member includes a shaft portion through which the swing axis passes, the contact member is formed from one conductive plate including a flexing portion that is flexed, the flexing portion is arranged in the shaft portion, and the plurality of movable contacts extends from both ends of the flexing portion.

5. The change-over switch according to claim 4, wherein the contact member includes a cut-and-raised portion cut and raised to form a frame-shaped portion that forms a frame shape together with the flexing portion, and the swing member includes a holding portion fitted onto the frame-shaped portion formed by the flexing portion and the cut-and-raised portion and configured to hold the contact member.

6. A switch device comprising:

a power source switch configured to open and close a circuit that supplies power to a power load; and the change-over switch according to claim 1, configured to change over electric power to be supplied to the power load.

7. The change-over switch according to claim 2, wherein the contact member is formed from one conductive plate.

8. The change-over switch according claim 2, wherein the swing member includes a shaft portion through which the swing axis passes, the contact member is formed from one conductive plate including a flexing portion that is flexed, the flexing portion is arranged in the shaft portion, and the plurality of movable contacts extends from both ends of the flexing portion.

9. The change-over switch according to claim 8, wherein the contact member includes a cut-and-raised portion cut and raised to form a frame-shaped portion that forms a frame shape together with the flexing portion, and the swing member includes a holding portion fitted onto the frame-shaped portion formed by the flexing portion and the cut-and-raised portion and configured to hold the contact member.

10. A switch device comprising:

a power source switch configured to open and close a circuit that supplies power to a power load; and the change-over switch according to claim 2, configured to change over electric power to be supplied to the power load.

* * * * *